US006049022A

United States Patent [19]

Tseng et al.

[11] Patent Number: 6,049,022

[45] Date of Patent: Apr. 11, 2000

[54] GRIPPING BANDAGE

[75] Inventors: Yung-lung Tseng; Min-ying C. Tseng; Conray C. Tseng, all of La Canada, Calif.

[73] Assignee: TCT Holdings, LLC, La Canada, Calif.

[21] Appl. No.: 08/966,515

[22] Filed: Nov. 10, 1997

[51] Int. Cl.[7] ..... A61F 13/00

[52] U.S. Cl. ..... 602/41; 602/22; 602/58

[58] Field of Search ..... 602/57, 8, 22, 602/41, 58

[56] References Cited

U.S. PATENT DOCUMENTS

| | | |
|---|---|---|
| 2,825,673 | 2/1958 | Schladermundt et al. . |
| 3,520,539 | 7/1970 | Haws . |
| 3,532,344 | 10/1970 | Masstab . |
| 3,649,967 | 3/1972 | Millman . |
| 4,061,820 | 12/1977 | Magid et al. . |
| 4,065,127 | 12/1977 | Fagan . |
| 4,597,578 | 7/1986 | Lancaster . |
| 4,653,492 | 3/1987 | Parsons . |
| 4,733,659 | 3/1988 | Edenbaum et al. . |
| 4,776,595 | 10/1988 | Wilkins . |
| 4,867,453 | 9/1989 | Winters . |
| 4,930,500 | 6/1990 | Morgan . |
| 4,974,846 | 12/1990 | Fenton . |
| 5,087,042 | 2/1992 | Solheim . |
| 5,167,613 | 12/1992 | Kamari et al. ..... 602/42 |
| 5,232,225 | 8/1993 | Snyder . |
| 5,322,286 | 6/1994 | Frost . |
| 5,322,290 | 6/1994 | Minami . |
| 5,333,753 | 8/1994 | Etheredge . |
| 5,348,303 | 9/1994 | Swissheim . |
| 5,398,930 | 3/1995 | Gibson . |
| 5,398,934 | 3/1995 | Soong . |
| 5,423,089 | 6/1995 | Chun . |
| 5,460,372 | 10/1995 | Cook . |
| 5,480,146 | 1/1996 | Comer . |
| 5,482,993 | 1/1996 | Hiraoka . |
| 5,571,051 | 11/1996 | Huang . |
| 5,588,920 | 12/1996 | Soong . |
| 5,588,921 | 12/1996 | Parsick . |
| 5,634,214 | 6/1997 | St. Ville . |
| 5,637,043 | 6/1997 | Fortis . |

*Primary Examiner*—Richard J. Apley
*Assistant Examiner*—Kelvin Hart
*Attorney, Agent, or Firm*—Sonnenschein Nath & Rosenthal

[57] ABSTRACT

A grip-aid gripping bandage adopted to be disposed over a finger or glove to protect the finger when using sports equipment or a hand tool and to provide enhanced control when using the sports equipment or hand tool. A first self-adhering strip is provided having a first predetermined length. A coat of adhesive material may be applied to a portion of a bottom surface of the first self-adhering strip. A second cushioning strip overlies a portion of and is bonded to an upper surface of the first self-adhering strip. The entire bandage, including the first self-adhering strip and the second cushioning strip, provides protection from abrasion) and pressure when the bandage is applied to a finger. In a further embodiment, an insert is disposed between the first self-adhering strip and the second cushioning strip for enhanced protection for the finger.

19 Claims, 4 Drawing Sheets

GRIPPING BANDAGE

BACKGROUND OF THE INVENTION

The present invention relates to self-adhering bandages used to improve the grip control for fingers and the protection of sensitive skin on the fingers while using sports equipment or hand tools.

The game of golf has been known as a strenuous exercise which uses only certain portions of the fingers from both hands to control the accuracy of a swing. Improvements for better grip control in the area of either the golf club grip or golf glove have been attempted in the past. They can be found in prior art patent disclosures shown in U.S. Pat. Nos. Minami 5,322,290, Hiraoka 5,482,993, Huang 5,571,051 and Fortis 5,637,043 for golf club grips and in U.S. Pat. Nos. Masstab 3,532,344, Joh 5,423,089 and Ville 5,634,214 for golf gloves.

During a golf game, gloves are generally used to protect sensitive skin on the hand while the improved golf club grips made of high friction materials are intended to provide nonslip capabilities to assist golfers achieve a solid and firm grip of the club. However, even with the gloves on, golfers still have calluses formed on the fingers because the conventional golf glove provides very little cushion for the fingers.

Many amateur golfers, using the improved non-slip golf club grips, still have problems controlling their swings. This problem is further complicated by the moisture from the perspiration of the hands during the play of golf which creates slippage between the hand and the golf club grip.

Most beginner golfers hold the golf club too tight and improperly. Consequently, they tend to lose control of their swing. In addition, calluses or even blisters can occur because the surface of the golf club grips currently available in the market, especially those made of high friction materials, is rough on the fingers. Many golf club houses offer bandages, such as Band-Aid® from Johnson and Johnson, for those golfers having callus or blister problems. Such bandages typically comprise a thin rectangular adhesive strip, made of synthetic material or cloth, with a small thin gauze pad positioned in and adhered to the center of the adhesive strip. Due to the nature of this type of bandage, the small thin gauze pad provides little cushion for the palm-side skin of the fingers, and the sticky adhesive material causes an unpleasant and uncomfortable feeling during a golf swing. Oftentimes, these bandages become out of shape after a few swings. To worsen the problem, moisture from the perspiration of the hands causes the golf club grip to become slippery.

These problems as described above are not unique with golfers or golf equipment. They are also common problems encountered while engaging in other sport activities or using hand tools. Therefore, the object of the present invention is not to be limited to the area of golf games or equipment.

SUMMARY OF THE INVENTION

It is an object of the present invention to provide a gripping-aid bandage for the finger which is easy to use, comfortable to wear, does not comprise sticky adhesive material, and is reusable.

It is another object of the present invention to provide a gripping-aid bandage for the finger which has an inner flexible self-adhering strip that absorbs moisture caused by hand perspiration, and a flexible self-adhering outer strip with a non-slip surface for better control of sports equipment or hand tools when gripped by the user.

It is an additional object of the present invention to provide a gripping-aid bandage for the finger which functions as a soft cushion between the palm-side skin of the fingers and the grip of sports equipment or hand tools to protect the skin from forming calluses or blisters.

It is a further object of the present invention to provide gripping-aid bandages for the finger which have different degrees of stretchability in the longitudinal direction and in the latitudinal direction.

The bandage of the present invention can be wrapped directly around a finger or indirectly over a sports glove. The bandage comprises multilayers of two different types of elastic self-adhering strips. These strips are rectangular in shape composed of a single layer or multilayers of elastic self-adhering material. In the present invention, the two types of rectangular strips are of a width that approximates the length of a segment of a finger. The strips are, however, different in length, and are firmly bonded together by mechanical pressure. The inner strip of the present invention is longer than the outer strip. This is the opposite of a traditional medical bandage. The inner strip is made of thin, lightweight, porous elastic material which absorbs moisture caused by hand perspiration while maintaining its self-adhering property. The outer strip of the bandage of the one embodiment of the present invention is made of a high friction non-slip elastic fiber material which provides better grip control when in contact with sports equipment or a hand tool. The outer strip is shorter than the inner strip such that the free ends of the inner strip can overlap each other to secure the bandage of the present invention around a finger. The addition of an insert between the inner strip and the outer strip, which can be made of foam or cotton base material, provides extra comfort and protection for fingers.

The game of golf is a strenuous exercise, using only certain portions of the fingers from both hands to control the accuracy of a swing. During a swing, golfers transfer hand grip pressure through certain segments of the fingers for swing control. Unfortunately, most golf club grips currently available in the market are not soft enough to protect the palm-side skin of these finger segments even if a golf glove is worn as a cushion. Calluses or blisters are constantly formed on those sensitive skin areas. The present invention functions as a soft cushion for the protection of fingers. Consequently, callus or blister problems are significantly reduced. The present invention further helps golfers transfer the grip pressure from those finger segments to the inner strip then through the non-slip outer strip onto the grip of the golf club. As the inner strip will absorb the moisture caused by hand perspiration, the grip of the club should be dry while the possibility of a slip or twist of the club is reduced due to the non-slip feature of the outer strip of the present invention. Therefore, better control of a golf swing can be achieved by using the present invention.

DETAILED DESCRIPTION OF THE PREFERRED EMBODIMENT

Figure 1:
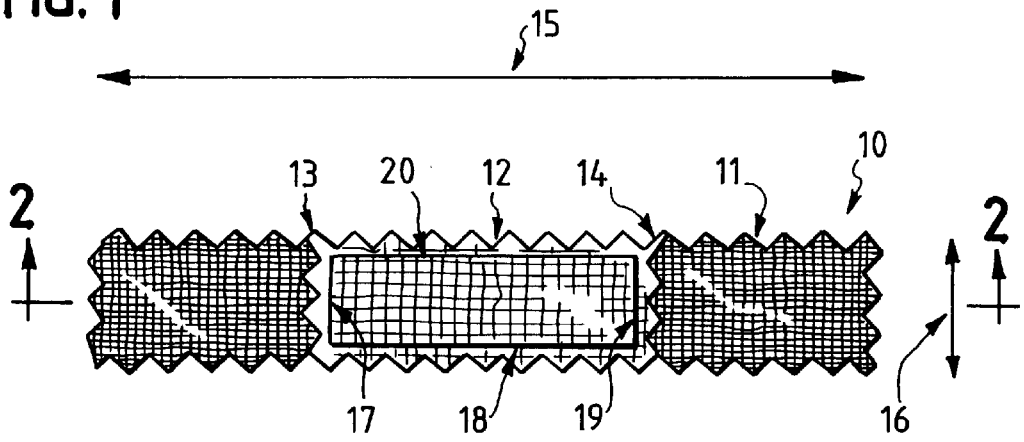
FIG. 1 is a top view of the gripping-aid bandage of the present invention having two different types of elastic self-adhering strips overlaying each other; the top rectangular strip is made of elastic fiber material with non-slip feature in the illustrated embodiment and the bottom rectangular strip go is thin, lightweight, porous material which can absorb hand moisture.
Figure 2:
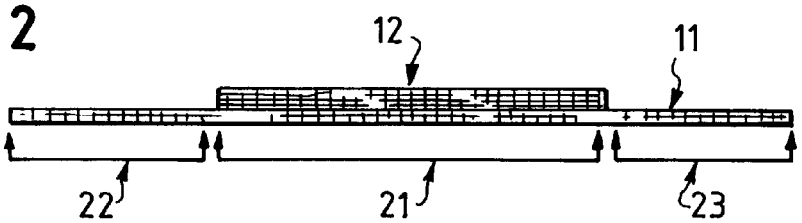
FIG. 2 is a cross-sectional elevation view of the bandage of FIG. 1, taken along line 2—2 of FIG. 1.

The first embodiment of the present invention is a gripping-aid bandage 10 without an insert, as shown in FIGS. 1 and 2, comprising two overlying different types of elastic self-adhering strips 11 and 12 bonded together. The first strip 11 is made of thin, lightweight, porous elastic material having an adhesive material applied to a portion of the underside of the strip 11. The adhesive material, however, is not necessary to the operation of the invention because the self-adhering characteristic of the material allows bonding to itself and between strips enabling a user to form a protective ring on their finger without having an adhesive material. Examples of this type of material useful in the present invention are Coban® and the like. Coban® is available from 3M Co. located in St. Paul, Minn. Coban® comprises a non-woven polyester fiber base material, elastic threads running through the base material in the longitudinal direction and a layer of latex. The elastic material of strip 11 can absorb hand moisture while maintaining its self-adhering property. Strip 11 also has good stretchability in the longitudinal direction as shown by arrow 15 in FIG. 1.

The second strip 12 is a cushion strip and is made of elastic fiber material and is shorter in the longitudinal direction than strip 11. Examples of this type of material useful in the present invention are Self-Grip® and the like. Self-Grip® is available from Dome Industries, a division of Dome Publishing Co., Inc. Warwick, R.I. Self-Grip® is a woven cotton base material containing 2% latex, and has a non-slip, high friction inner and outer surface and good stretchability in the longitudinal direction as indicated by arrow 15. Due to the good stretchability characteristic in the longitudinal direction as indicated by arrow 15 of both self-adhering materials used in the present invention, the present invention can be constructed in four basic forms to provide different ago stretchability properties both in the longitudinal direction indicated by arrow 15 and in the latitudinal direction indicated by arrow 16. As illustrated in FIGS. 1 and 2, second cushion strip 12 is bonded to a topside of strip 11.

In a first embodiment of the construction of the above described gripping-aid bandage 10 illustrated in FIGS. 1 and 2, the thin, lightweight, porous, elastic, self-adhering material, used for the inner strip 11 is cut to form a multilayer rectangular strip, for example triple layers of the same material with a size of 4 inch×11/16 inch, with good stretchability characteristics in the longitudinal direction shown by arrow 15. The elastic self-adhering fiber material, used for the outer strip 12 of the bandage 10, is also cut in the same way to provide a double layer strip of the same material, for example having a size of 2 inch×11/16 inch such that both layers also have the same stretchability in the longitudinal direction shown by arrow 15. Before overlaying the double layers of strip 12 on top of the inner strip 11 at the center, both ends 13 and 14 of the outer strip 12 are self-adhered by applying mechanical pressure. The strips 11 and 12 are then adhered to each other by applying mechanical pressure in a nonlinear pattern, such as zigzag along all four sides of the bandage 10. In one embodiment of the present invention, pressure is applied at four edges 17, 18, 19, and 20 of the outer strip 12 to seal the strip 12 further onto the inner strip 11 by using a thin line edge tool. This embodiment of the present invention provides maximum stretchability in the longitudinal direction shown by arrow 15.

A second construction embodiment of the bandage 10 illustrated in FIGS. 1 and 2 incorporates the same steps as described above for the first construction embodiment, except that the outer strip 12 is cut differently. The outer strip 12 of this embodiment has good stretchability in the latitudinal direction shown by arrow 16 instead of in the longitudinal direction shown by arrow 15 as in the previous construction embodiment. Accordingly, this embodiment of bandage 10 reduces the stretchability in the longitudinal direction shown by arrow 15 at the overlapping area 21, as shown in FIG. 2.

A third construction embodiment of the bandage 10 illustrated in FIGS . 1 and 2 incorporates the same steps as those described above for the first construction embodiment, except that the inner strip 11 is cut differently. The inner strip 11 in this construction embodiment has good stretchability in the latitudinal direction of arrow 16 instead of in the longitudinal direction of arrow 15. Accordingly, the bandage 10 constructed in accordance with this embodiment will have reduced stretchability in the longitudinal direction of arrow 15 at both the overlapping area 21 and the non-overlapping areas 22 and 23 as shown in FIG. 2.

A fourth construction embodiment of the bandage 10 illustrated in FIGS. 1 and 2 incorporates the same steps as those described above for the first construction embodiment, except that both inner strip 11 and outer strip 12 are cut in such a way that both strips 11 and 12 have good stretchability in the latitudinal direction of arrow 16 instead of in the longitudinal direction of arrow 15. This construction embodiment of the present invention reduces the stretchability in the longitudinal direction of arrow 15 to a minimum, yet increases the stretchability in the latitudinal direction of arrow 16 to a maximum.

Figure 3:
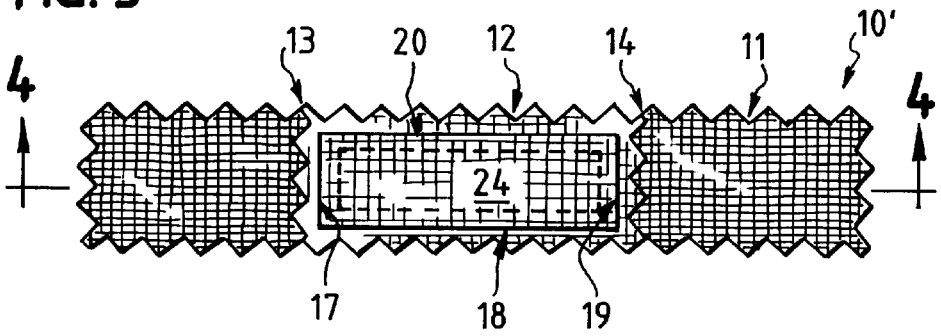
FIG. 3 is a top view of an additional embodiment of the present invention, having an insert between the inner strip and the outer strip.
Figure 4:
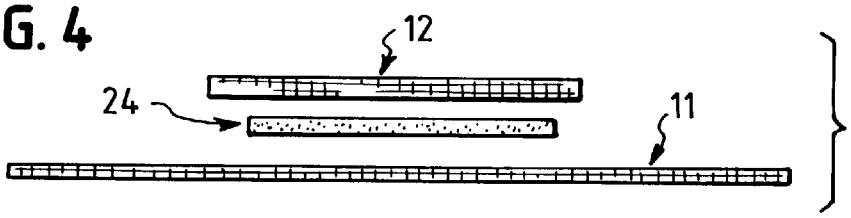
FIG. 4 is a cross-sectional elevational view of bandage of FIG. 3 taken along line 4—4 of FIG. 3, showing an insert between the inner strip and the outer strip before they are assembled.
Figure 5:
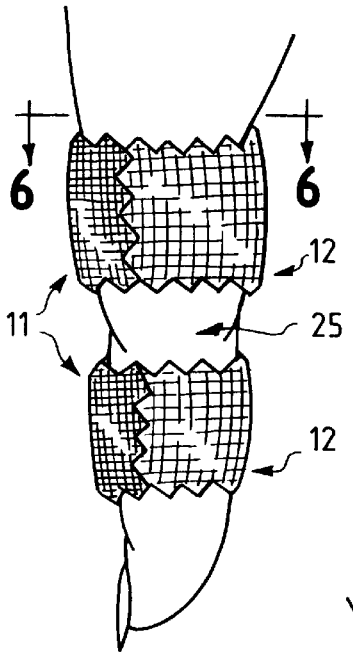
FIG. 5 is a perspective view of the bandages of the present invention applied on a segment of a finger.
Figure 7:
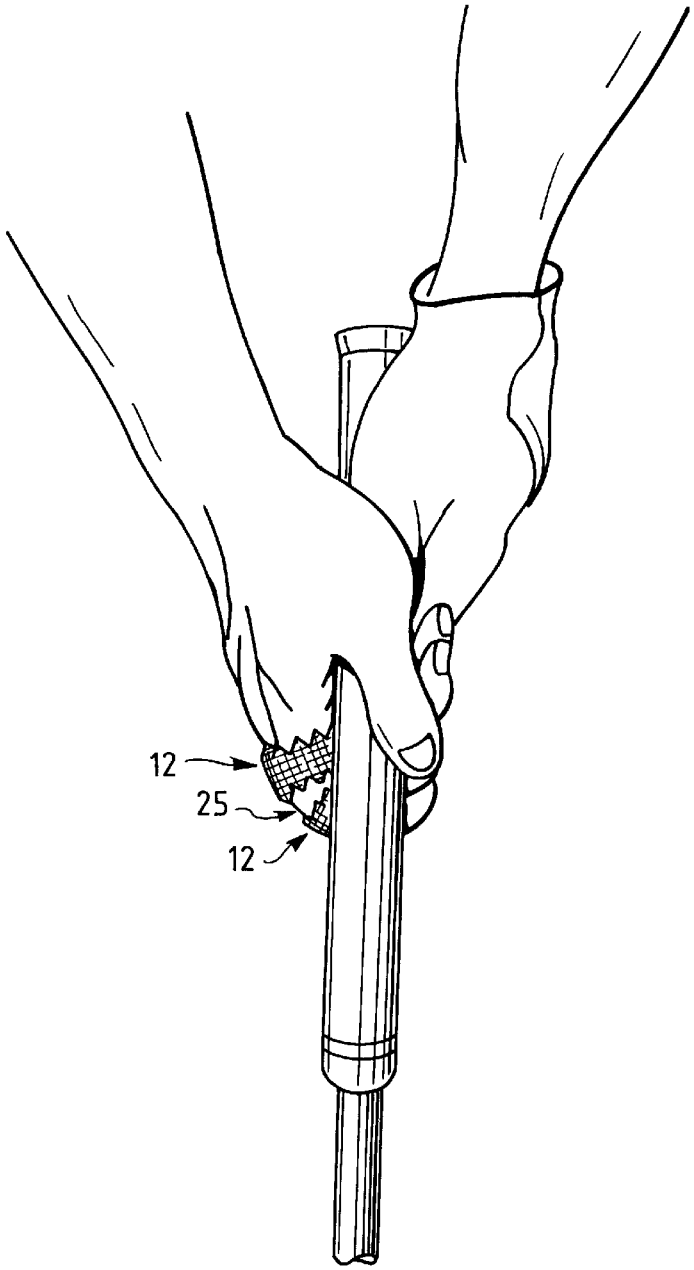
FIG. 7 is a perspective view of the bandages of the present invention applied to protect the sensitive skin areas on right hand fingers that hold a golf club.
Figure 6:
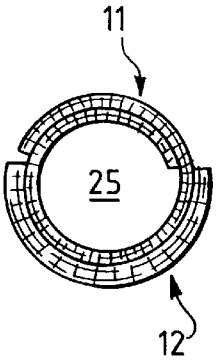
FIG. 6 is a cross-sectional view of FIG. 5 taken along line 6—6 of FIG. 5, showing how the inner elastic self-adhering strip overlaps and self-adheres to form a small cylindrical ring around a segment of a finger.
Figure 8:
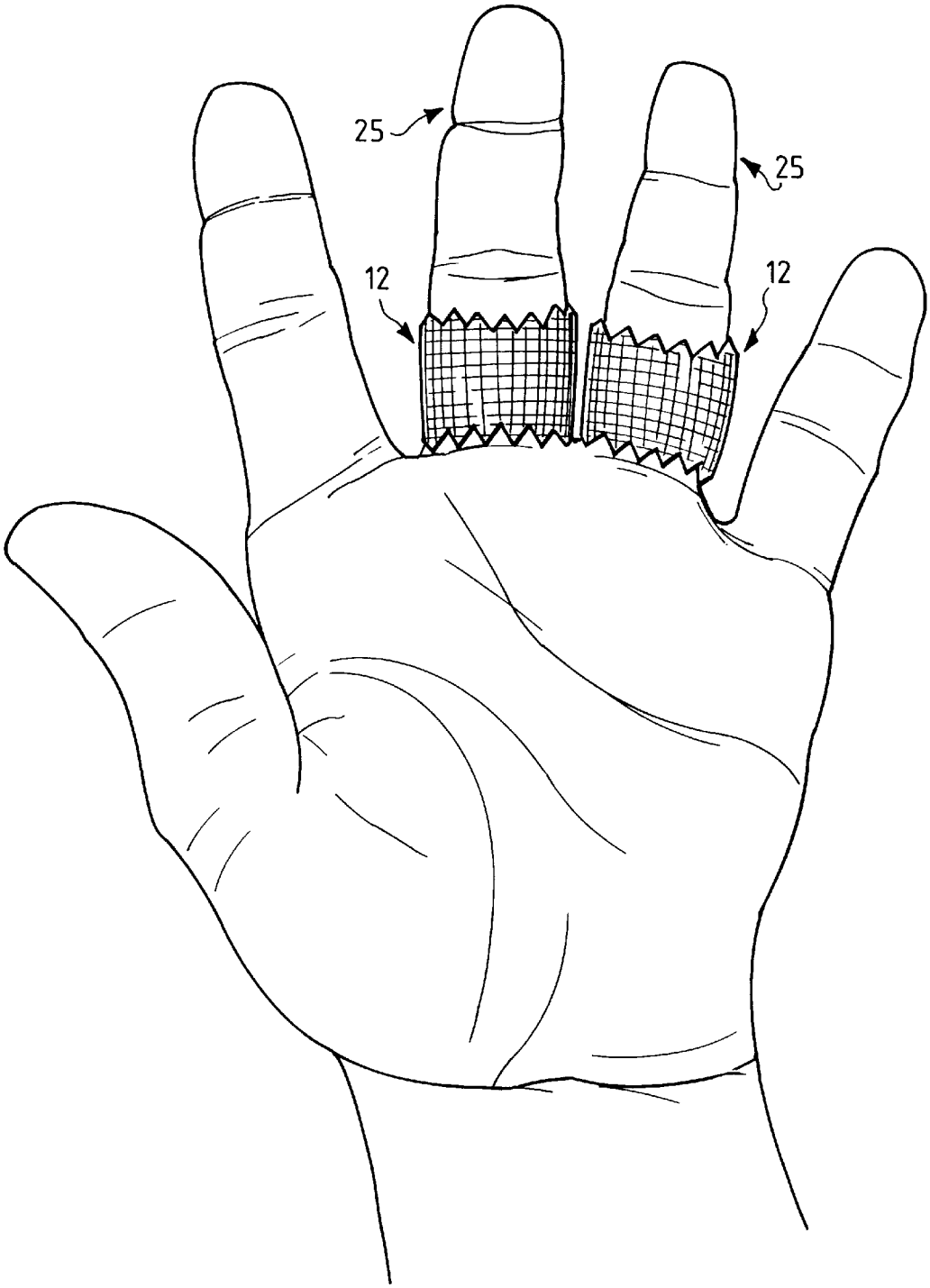
FIG. 8 is a perspective view of the bandages of the present invention applied to protect the sensitive skin areas on left hand fingers.

With respect to each of the above four basic construction forms of the present invention, FIG. 4 illustrates a further embodiment of the invention designated 10 wherein an insert strip 24 is added between the triple-layered inner strip 11 and the single-layered outer strip 12, as shown in FIG. 3 and FIG. 4. By way of example, Insert 24 can comprise single or multiple layers of foam or cotton base material and is used to provide extra comfort and protection for the finger during use of the bandage 10' to grip a sports implement or a hand tool.

The present invention can be wrapped directly around a finger or fingers 25 as shown in FIG. 5 to FIG. 8 with outer strip 12 facing away from the finger 25. The self-adhering characteristics of the outer ends of inner strip 11 cause the bandage 10,10' to adhere to itself the same as, upon application of a standard skin bandage, which holds the bandage 10,10' firmly in place on the finger 25, as specifically illustrated in FIG. 6.

Figure 9:
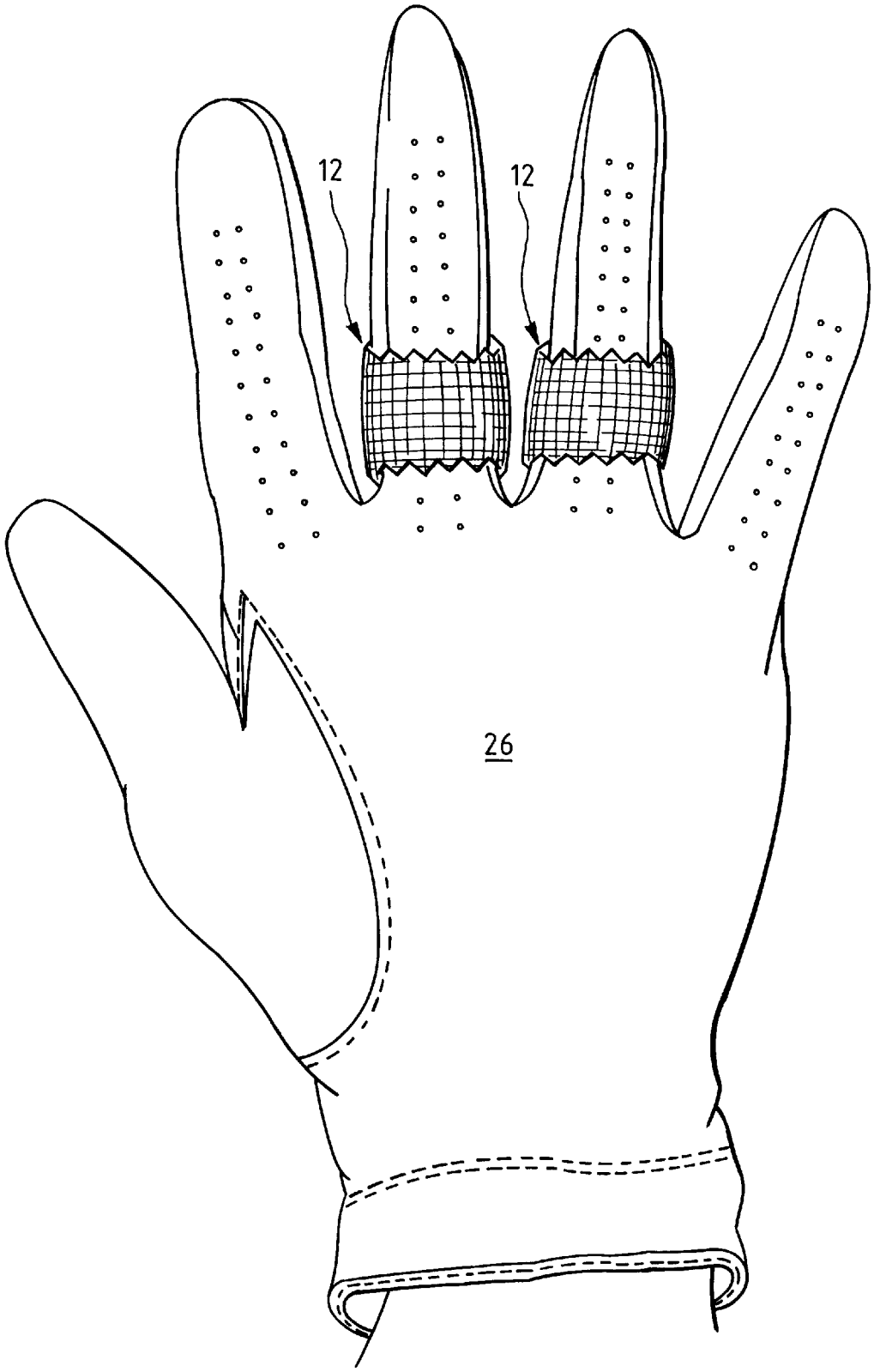
FIG. 9 is a perspective view of the bandages of the present invention applied over a golf glove to provide golf swing control and finger protection.

The bandage 10,10' may also be applied over the finger or fingers of a sport glove 26 as shown in FIG. 9. The unique combined features of the inner strip 11 and the outer strip 12 of the present invention provide better grip control for the fingers and the protection of sensitive skin on the fingers while using sports equipment or hand tools.

Although, it has been shown and described with details using exemplary embodiments of the present invention, it will be understood that various changes in form, size, the number of layers of material and the pattern used to seal all sides of the present invention may be made without departing from the spirit and scope of the claimed invention.

We claim:

1. A gripping bandage adapted to be disposed over a finger to protect the finger when using a sports or hand tool implement, the bandage comprising:

a first self-adhering strip having a first predetermined length;

a second elastic impact cushioning strip overlying a portion of, permanently and sealingly bonded to, the first self-adhering strip;

the second cushioning strip providing protection from abrasion and pressure when the bandage is applied to a finger.

2. The gripping bandage of claim 1 wherein the first self-adhering strip is composed of elastic material.

3. The gripping bandage of claim 1 wherein the second cushioning strip has a length shorter than the first predetermined length of the first strip.

4. The gripping bandage of claim 1 wherein the first strip and the second cushioning strip are of substantially equal width.

5. The gripping bandage of claim 1 wherein the first self-adhering strip comprises a non-woven polymer fiber base material.

6. The gripping bandage of claim 1 wherein the first strip maintains its self-adhering capability when wet.

7. The gripping bandage of claim 1 wherein the elastic material comprising the second cushioning strip is a woven cotton base material containing latex.

8. The gripping bandage of claim 1 wherein the second cushioning strip includes a high friction outer surface.

9. The gripping bandage of claim 1 wherein the first self-adhering strip is elastic in a longitudinal direction, and the second cushioning strip is elastic in a longitudinal direction.

10. The gripping bandage of claim 1 wherein the second cushioning strip is elastic in a latitudinal direction, and the first self-adhering strip is elastic in a longitudinal direction.

11. The gripping bandage of claim 1 wherein the first self-adhering strip is elastic in a latitudinal direction, and the second cushioning strip is elastic in a longitudinal direction.

12. The gripping bandage of claim 1 wherein the first self-adhering strip is elastic in a latitudinal direction, and the second cushioning strip is elastic in a latitudinal direction.

13. A gripping bandage adapted to be disposed over a finger to protect the finger when using a sports or hand tool implement, the bandage comprising:

a first self-adhering strip having a first pre-determined length;

a second elastic cushioning strip overlying a portion of, and bonded to, the first self-adhering strip;

the second cushioning strip providing protection from abrasion and pressure when the bandage is applied to a finger; and the first self adhering strip comprising a non-woven polymer fiber base material with elastic threads extending through the fiber base material in a longitudinal direction.

14. A gripping bandage adapted to be disposed over a finger to protect the finger when using a sports or hand tool implement, the bandage comprising;

a first self-adhering strip having a first pre-determined length;

a second elastic cushioning strip overlying a portion of, and bonded to, the first self-adhering strip;

the second cushioning strip providing protection from abrasion and pressure when the bandage is applied to a finger; and the first self adhering strip comprising a non-woven polymer fiber base material and a layer of latex.

15. A bandage adapted to be disposed over a finger to protect the finger when using a sports or hand tool implement, the bandage comprising;

a first self-adhering strip having a fist predetermined length;

a second elastic cushioning strip overlying a portion of, and bonded to the first self-adhering strip;

the second cushioning strip providing protection from abrasion and pressure when the bandage is applied to a finger, an insert strip disposed between the first self-adhering strip and the second cushioning strip.

16. The gripping bandage of claim 15 wherein the insert strip comprises at least one layer of foam material.

17. The gripping bandage of claim 15 wherein the insert strip comprises at least one layer of cotton based material.

18. A gripping bandage adapted to be disposed over a finger portion of a glove to protect the finger inside the glove when the glove is worn when using a sports or hand tool implement, the bandage comprising:

a first self-adhering strip having a first predetermined length;

a second elastic impact cushioning strip overlying a portion of, permanently and sealingly bonded to, the first self-adhering strip;

the second cushioning strip providing protection from abrasion and pressure when the bandage is disposed over a finger portion of the glove and the glove is worn when using a sports or hand tool implement.

19. A gripping bandage adapted to be disposed over a finger to protect the finger when using a sports or hand tool implement, the bandage comprising:

a first self-adhering strip having a first predetermined length;

a coat of adhesive material applied to a portion of a bottom surface of the first self-adhering strip;

a second elastic impact cushioning strip overlying a portion of, permanently and sealingly bonded to, the first self-adhering strip;

the second cushioning strip providing protection from abrasion and pressure when the bandage is applied to a finger.

* * * * *